US008602246B2

(12) United States Patent
Frohwein

(10) Patent No.: US 8,602,246 B2
(45) Date of Patent: Dec. 10, 2013

(54) DISPOSABLE DUAL CHAMBER CONTAINER

(76) Inventor: Daniel M. Frohwein, Orlando, FL (US)

( * ) Notice: Subject to any disclaimer, the term of this patent is extended or adjusted under 35 U.S.C. 154(b) by 740 days.

(21) Appl. No.: 12/705,319

(22) Filed: Feb. 12, 2010

(65) Prior Publication Data

US 2011/0198354 A1 Aug. 18, 2011

(51) Int. Cl.
*B65D 1/36* (2006.01)

(52) U.S. Cl.
USPC ..... 220/530; 220/500; 220/520; 206/484; 206/528; 206/532; 206/534; 206/538; 206/539; 206/540; 206/822; 206/824; 222/106; 222/108; 222/115; 222/122; 222/123; 383/38; 383/41; 383/209; 383/906; 383/907

(58) Field of Classification Search
USPC ..... 220/500, 520, 530; 206/528, 532, 534, 206/538, 539, 540, 484, 822, 824; 222/107, 222/129, 142.1, 142.4, 196.1, 215, 457.5, 222/478, 481, 541.1, 541.6, 541.9; 229/106, 108, 115, 122, 123; 383/38, 383/41, 209, 906, 907
See application file for complete search history.

(56) References Cited

U.S. PATENT DOCUMENTS

| | | | | |
|---|---|---|---|---|
| 1,438,487 | A | 12/1922 | Greene | |
| 1,886,115 | A | 11/1932 | Wilhelm | |
| 3,224,640 | A | 12/1965 | Schneider | |
| D205,635 | S | 8/1966 | Corella | |
| D222,236 | S | 10/1971 | Peragine | |
| D276,017 | S | 10/1984 | Brewster | |
| 5,052,554 | A | 10/1991 | Leonard | |
| 5,269,475 | A | 12/1993 | Diefenbach | |
| 5,316,400 | A | 5/1994 | Hoyt | |
| 5,388,699 | A | 2/1995 | Ratajczak | |
| 5,460,620 | A | 10/1995 | Smith | |
| 5,461,845 | A | 10/1995 | Yeager | |
| 5,881,869 | A | 3/1999 | Hudson | |
| 6,244,467 | B1 | 6/2001 | Lewit | |
| 6,247,617 | B1 | 6/2001 | Clyde | |
| 6,347,725 | B1 | 2/2002 | Yoakim | |
| 6,360,916 | B1 | 3/2002 | Sokolsky | |
| 6,422,753 | B1 | 7/2002 | Thomas | |
| D505,335 | S | 5/2005 | Grenda | |
| 6,929,399 | B2 * | 8/2005 | Nokura | 383/38 |
| 7,241,066 | B1 | 7/2007 | Rosen | |
| D578,015 | S | 10/2008 | Friedland | |
| D578,019 | S | 10/2008 | Friedland | |
| 2007/0029275 | A1 | 2/2007 | Hantman | |

OTHER PUBLICATIONS

Search Report in PCT/US2011/023842 (counterpart to this application).

* cited by examiner

*Primary Examiner* — Anthony Stashick
*Assistant Examiner* — Elizabeth Volz
(74) *Attorney, Agent, or Firm* — Muskin & Cusick LLC

(57) ABSTRACT

A dual-chamber container with independent or combined access includes two individual chambers made of a breachable material such as, but not limited to, a paper product. The container can be made from a unitary blank that is foldable to create a substantially triangular body. The triangular body includes a first and a second superimposed triangular chamber, each chamber having a distinct interior space for holding a dispensable substance. A first and a second access fin are positioned at each of a respective first and a second corner of the body, each access fin contiguous with a respective one of the first and the second chamber. The interior space of each chamber is individually accessible by removing a respective one of the access fins, thereby breaching it's respective chamber.

26 Claims, 18 Drawing Sheets

DISPOSABLE DUAL CHAMBER CONTAINER

BACKGROUND OF THE INVENTION

1. Field of the Invention

The present inventive concept relates to devices for delivering solid and/or pourable substances, such as powders and liquids. More particularly, the present inventive concept relates to a multi-compartment container for delivering edible and non-edible substances, and methods for making and using same.

2. Description of the Related Art

Sachets are known in the art for containing a liquid, powder, cream, paste, or other material. Typically a sachet comprises a small, single-use flexible container that is relatively flat in cross section. When sachets become large and bulky, such as a potato chip bag, they are often called pouches. Sachets are typically constructed by folding a flexible strip of material longitudinally and sealing all but one of the edges, which is then sealed after filling the sachet's inner space with a substance to be dispensed. The resulting formed pockets can then be separated, completing the sachet proper. Each sachet typically contains a predetermined aliquot of the substance to be consumed or otherwise utilized. Sachets may contain tear notches, perforations, or nicks, advantageously placed such that when torn through, allow partially controlled access to the contents therein.

Sachets and pouches can be constructed from a variety of different materials, or films. Materials may include a paper product, plastic, metalized plastic, aluminum foil, or more complex films containing up to five or six layers of these.

Sachets are ubiquitous in many industries, including the food and beverage, personal hygiene, pharmaceutical, cosmetic, medical, confectionary, as well as the travel and hospitality industries. They can contain single-use, dispensable quantities of edible substances, as well as non-consumable substances commonly for personal use. The contents found in sachets typically fall into two categories, including solid substances such as powders, pills, and granules, and flowable substances, such as gels, solutions, and dispersions. Solid substances are generally pourable such that gravity alone is required to extract the contents from an opened sachet. Flowable substances are variably pourable, and their extraction may require additional digital compression by the fingers of the operating hand, dependent on the viscosity of the substance in question. Alternatively, extraction with assistance of a small utensil may be envisioned. Occasionally, other items may be found in conventional sachets, such as tablets or capsules, towelettes, applicator pads, and prophylactic devices. Larger pouches are equally as common and have found wide acceptance in food packaging, containing salty snack items, candy, nuts, dried fruit, and the like.

It is very common to encounter a situation in which it may be desirous to use several substances from various sachets in concurrent or consecutive fashion. Additionally, there are instances in which it is advantageous to utilize two aliquots of a single substance in a sequential manner, keeping the second aliquot sealed until immediately prior to consumption. It would therefore be particularly helpful to have a dual-chamber sachet that would facilitate combined or sequential access of contents. Such examples might be the simultaneous application of ketchup and mustard to a hamburger, or the sequential application of shampoo and conditioner to ones hair. In addition to pairing of complementary substances for consumption during one activity, such as eating or bathing, it would be advantageous to have a container that would be appropriate for the inclusion of a flowable substance in one chamber of the dual-chambered container, and a solid substance in the other chamber.

It is also realized that in certain circumstances, though while using two substances together for a single activity, it is necessary to keep the substances segregated until immediately prior to use. Such examples are when one is mixing together two ingredients to activate a solution, as in epoxy adhesives and hair coloring agents. In these circumstances it would be especially beneficial if the dual-chambered sachet dispensing regions were on opposite sides of the package in order to prevent inadvertent early mixing of ingredients.

A useful application of a flowable and a solid substance combination would be the inclusion of both cream and sugar in a single container, provided as an appurtenance for coffee shops and "on the go" type coffee establishments. A single container, containing the most commonly employed coffee customizing substances, would simplify the addition of these condiments to hot coffee. Currently, coffee shops typically contain coffee customizing stations, housing coffee accoutrements and other additives. These stations become crowded during busy operating hours, and frequently customers find themselves waiting in a second line to customize their coffee after standing in line for the original coffee purchase. Coffee customizing areas quickly become unsightly and unsanitary, and require routine cleaning and restocking by employees. The possibility of contamination of the ingestible substances at these stations exists. Additionally, customers obtaining their coffee at drive through establishments currently face the undesirable option of allowing the employees of said establishment to customize their coffee for them, which may result in errors, and therefore dissatisfaction with the taste of the coffee. It also slows down the processing of customer orders, increasing wait times at the drive through window thereby decreasing revenues for coffee establishments.

Coffee "on-the-go" is offered in a variety of sizes, ranging from the customary 8-oz cups up to and including a large 20-oz cup size. Currently, cream and sugar are enclosed in small, sealed thermoformed cups and conventional paper sachets, respectively. To customize one's coffee, an individual may typically need to open a plurality of the small sealed thermoformed cups of cream as well as a plurality of individual sugar sachets in order to provide the desired level of customization to taste. It is clear that it would be beneficial to provide a sachet that would be scalable in size, since it is realized from this example that while the Styrofoam cups in which on the go coffee is typically served have increased in size, the condiment containers that service coffee in these increased volumes have not increased commensurately in scale. The alacrity and simplicity that an easy-to-use, single container would provide would greatly enhance the coffee customer's satisfaction, both at the retail coffee shop, and at the drive-through window. Coffee customizing stations can be eliminated or reduced in scope and size, and customers need not wait for their turn at them as cream, sugar, and other additives can be provided at the point of sale. For customers patronizing drive-through establishments, they can be provided the freedom to individualize their own coffee as well as the ability to do so more safety while simultaneously operating a motor vehicle.

SUMMARY OF THE INVENTION

It is an aspect of the present general inventive concept to provide an improved multi-compartment container.

The above aspects can be obtained by a container, comprising (a) a first chamber filled with a first substance; (b) a second chamber filled with a second substance, the second chamber being adjacent to and superimposed on the first chamber; (c) a first access fin located at a first corner of the container that when removed, breaches the first chamber, exposing the first substance; and (d) a second access fin located at a second corner of the container that when removed, breaches the second chamber, exposing the second substance.

The above aspects can also be obtained by a method that includes (a) providing a flat material, or sheet; (b) pre-cutting the sheet into a blank; (c) forming a container by folding the blank; (d) the container comprising: (e) a first chamber; (f) a second chamber, the second chamber being adjacent to and superimposed on the first chamber; (g) a first access fin located at a first corner of the container that when removed, breaches the first chamber, exposing the first substance; and (h) a second access fin located at a second corner of the container that when removed, breaches the second chamber, exposing the second substance.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
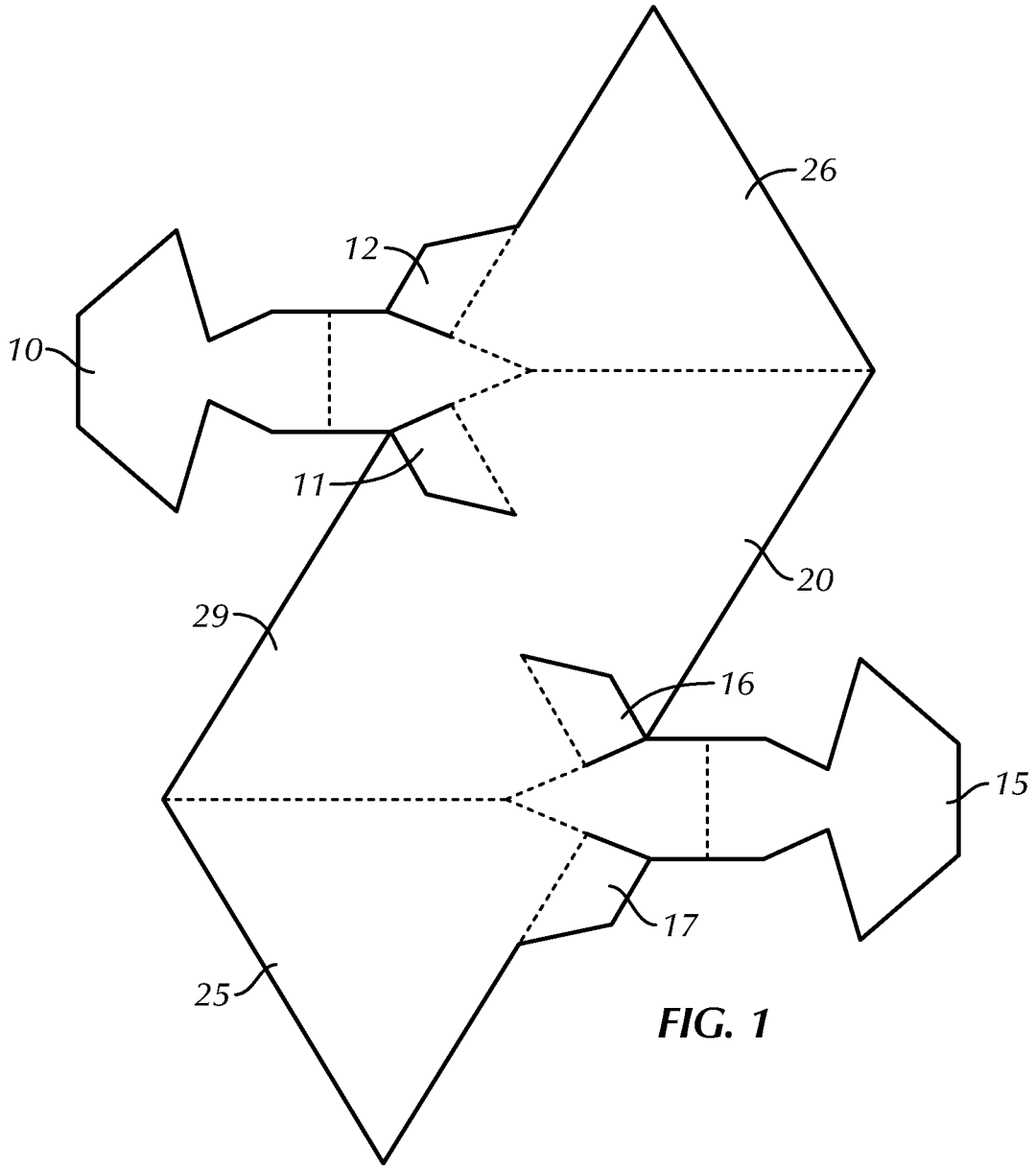
FIG. 1 is a flat view of a first container, comprising a first blank not yet constructed, according to an embodiment.

Reference will now be made in detail to the presently preferred embodiments of the invention, examples of which are illustrated in the accompanying drawings, wherein like reference numerals refer to like elements throughout.

The present invention has a first aspect that includes a dual-chamber sachet (pouch) with independent or combined access. The multi-chamber container comprises two individual chambers comprising a breach-able material such as, but not limited to, a paper product. The container is arranged so that one or both chambers can be accessed individually or simultaneously.

The container is foldable and sealable to create a substantially triangular body. The triangular body comprises a first and a second superimposed triangular chamber, each chamber having a distinct interior space for holding a dispensable substance. A first and a second access fin are positioned at each of a respective first and a second corner of the body, each access fin contiguous with a respective one of the first and the second triangular chambers. The interior space of each chamber is individually accessible by removing a respective one of the access fins, thereby breaching the respective chamber; both chambers are simultaneously accessible by breaching both of the first and the second chambers adjacent a third free corner of the triangular body. In some embodiments the access fins can be transversely oriented, so that they are substantially perpendicular to a plane through the maximal cross-sectional area of the individual chambers.

The present invention provides a dual-chamber container that has an aesthetically pleasing design. The container has broad applicability and utility, is scalable for the intended function, is capable of dispensing both consumable and non-consumable products, and both solid and flowable substances.

If it is desired to access the chambers individually, the opposed access fins provide optimal separation and segregation of the chambers' contents. Once a chamber is accessed, spillage can be prevented by folding over the corner adjacent the access fin.

FIGS. 1-19 illustrate one method of constructing an embodiment of the present invention, by folding up a sheet of material pre-cut into a particular shape (a blank) and affixing parts of the blank together in order to create a complete container. Note that dashed lines are to be folded while solid lines are cut. This process comprises a variant of the form, fill, and seal method of constructing a typical sachet.

This is but one manner in which the container can be constructed. Other methods can be contemplated as well, such as injection molding, thermoforming, blow molding, rotational molding, vacuum forming, 3D photocopying, among other methods known to those skilled in the art. Thus, a variety of materials and substrates can be envisioned for constructing the invention which would be dependent on the method of construction undertaken, including but not limited to, paper products, multi-layer films, foils, plastics, polymers, elastomers, and combinations thereof.

Additionally, when utilizing a blank to construct an embodiment of the invention using folding sequences illustrated in FIG. 1-18, a variety of adhesive types may be used, to include natural, synthetic, drying, contact, hot, reactive, ultraviolet and light curing, and pressure-sensitive as well as others known to one skilled in the art.

It is further noted that when folding a template blank, additional folding and affixing sequences may be employed to construct a completed container. The folding sequences demonstrated in FIGS. 1-8 and FIGS. 12-18 represent examples of typical folding sequences and in no way place limitations upon the scope of the invention.

FIG. 1 is a flat view of a flat first container not yet constructed, according to an embodiment. FIG. 1 (and other figures) show dashed lines which can be folded while cuts can be made on the solid lines. The sheet illustrated in FIG. 1 can be considered to embody the container illustrated in FIG. 8, since when folded and cut along the markings the original flat sheet will form the finished container.

A first center tab 10 extends from a parallelogram-shaped body. The first center tab 10 has a left flanking tab 11 and a right flanking tab 12. A second center tab 15 also extends from the parallelogram shaped body. The second center tab 15 has a left flanking tab 16 and a right flanking tab 17. First and second outer triangular sections 26 and 25 are opposite first and second inner triangular sections 20 and 29.

Figure 2:
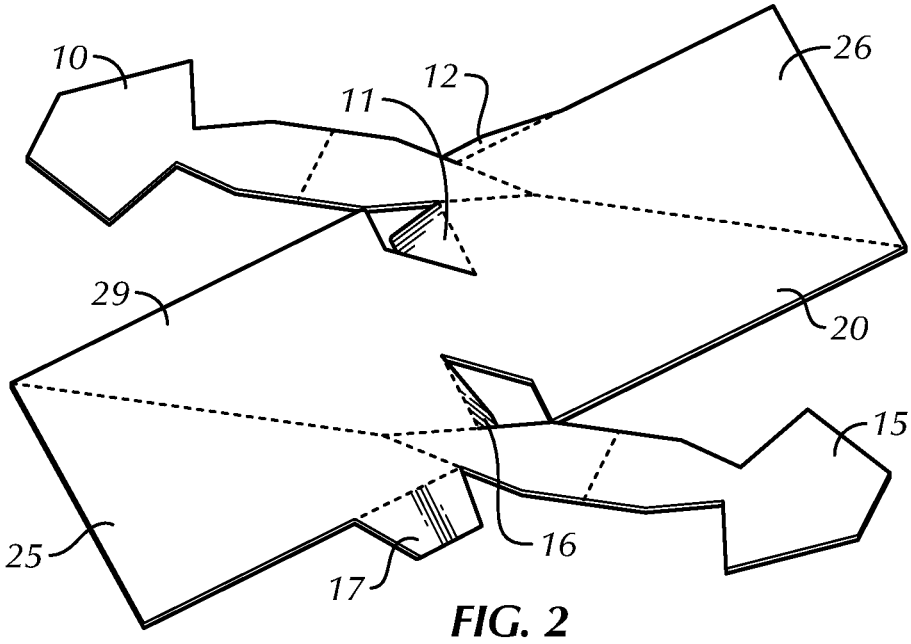
FIG. 2 is an orthogonal view of a first blank with flanking tabs folded, according to an embodiment.

FIG. 2 is an orthogonal view of a first blank with flanking tabs folded, according to an embodiment.

The left flanking tab 11 and the right flanking tab 12 of the first center tab 10 are folded. The left flanking tab 16 and the right flanking tab 17 of the second center tab 15 are folded.

Figure 3:
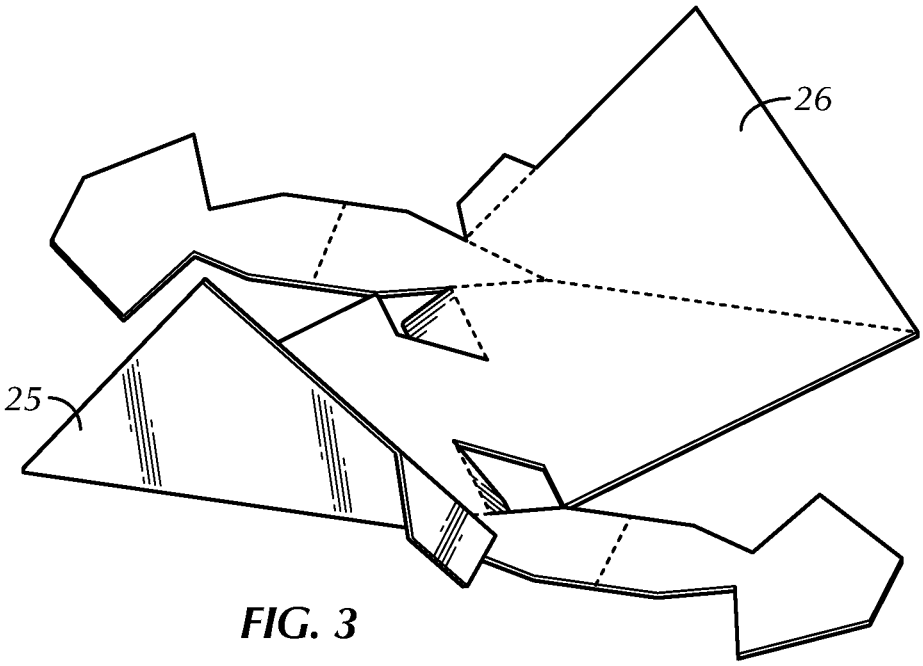
FIG. 3 is an orthogonal view of a first blank with triangular sections folded, according to an embodiment.

FIG. 3 is an orthogonal view of a first blank with triangular sections folded, according to an embodiment.

The first outer triangular section 26 and the second outer triangular section 25 are folded.

Figure 4:
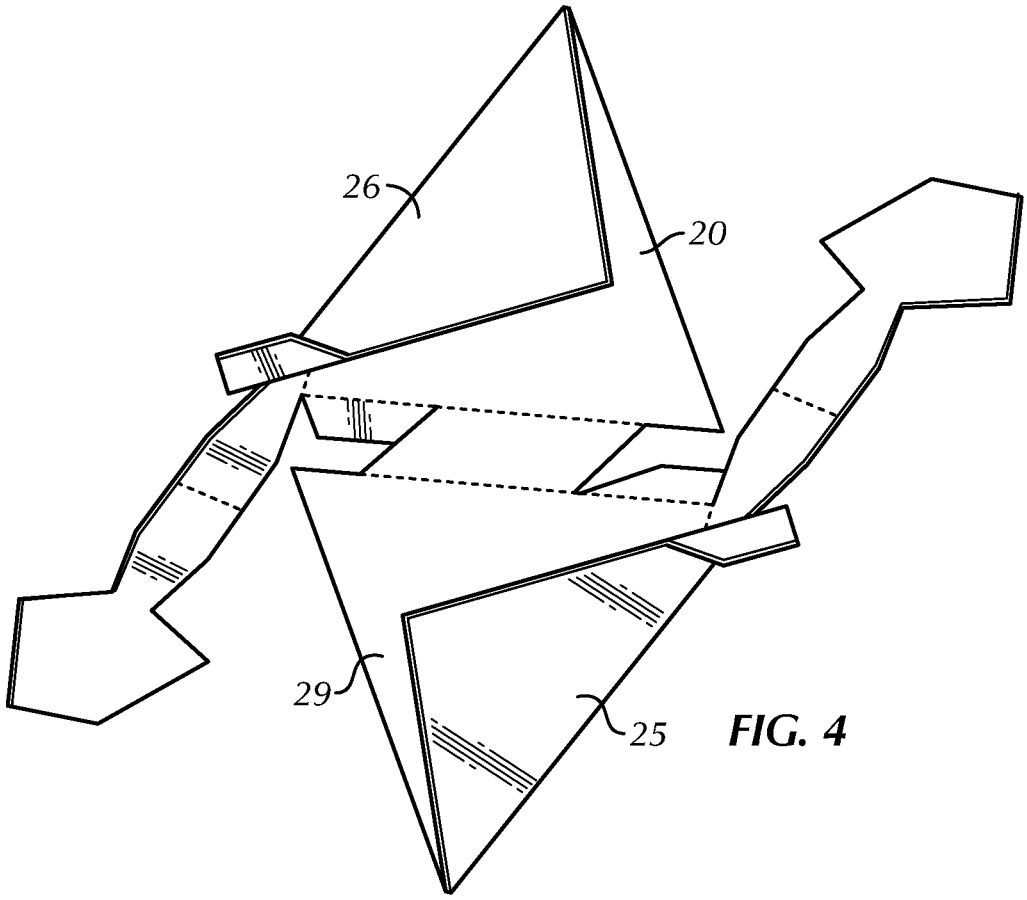
FIG. 4 is a further orthogonal view of a first blank with triangular sections folded, according to an embodiment.

FIG. 4 is a further orthogonal view of a first blank with triangular sections folded, according to an embodiment.

Figure 5:
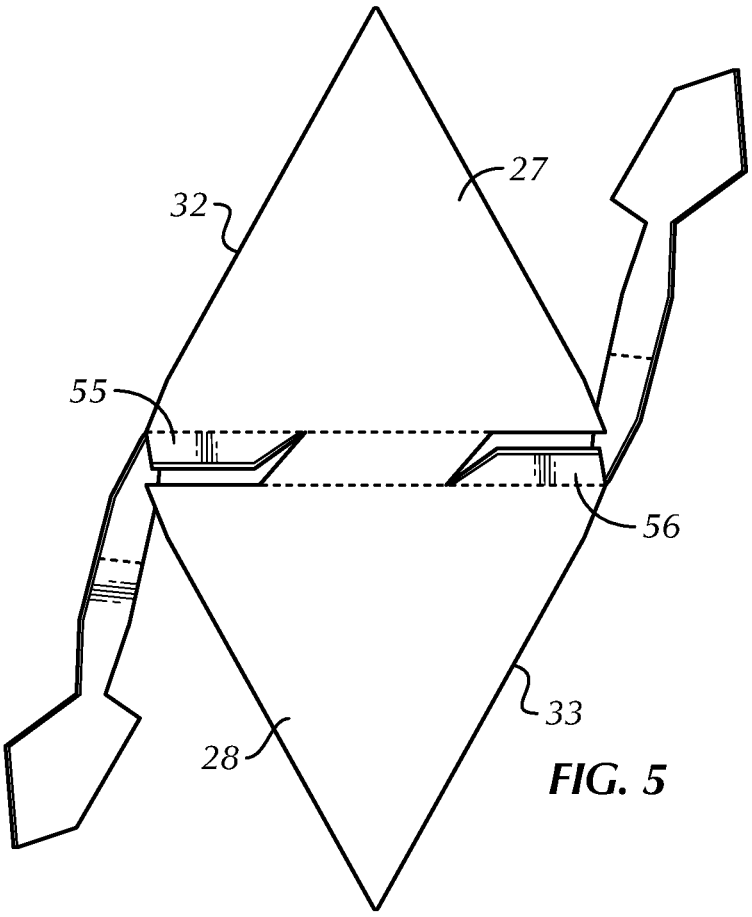
FIG. 5 is an orthogonal view of a first blank with sealed triangular sections, according to an embodiment.

FIG. 5 is an orthogonal view of a first blank with sealed triangular sections, forming hollow chambers, according to an embodiment.

The first outer triangular section 26 and the first inner triangular section 20 are now completely folded forming first hollow chamber 27. The second outer triangular section 26 and the second inner triangular section 29 are now completely folded forming second hollow chamber 28. Note that a first portion 55 of the first chamber's 27 perimeter remains unsealed and a second portion 56 of the second chamber's 28 perimeter remains unsealed at this time. Other portions of the first and second chamber's perimeter may remain unsealed as well.

From FIG. 5, the first chamber 27 and the second chamber 28 are folded and superimposed upon each other.

Chamber 27 is folded forward and downward to superimpose upon chamber 28.

Figure 6:
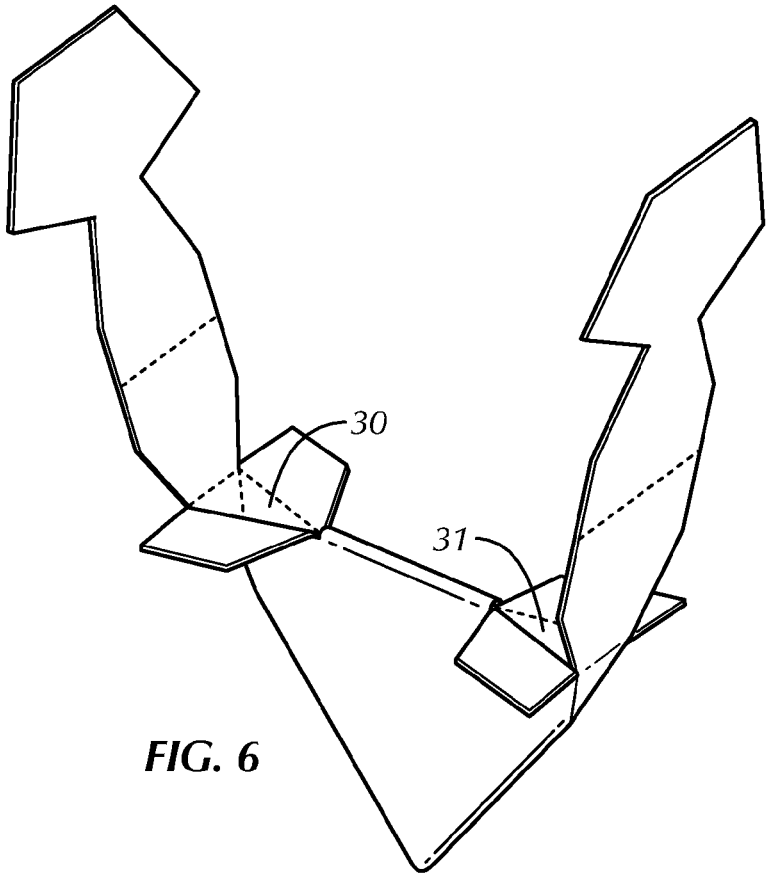
FIG. 6 is an orthogonal view of a first blank with extended center tabs, according to an embodiment.

FIG. 6 is an orthogonal view of a first blank with extended center tabs, according to an embodiment.

A first triangular opening 30 may be used to insert a first substance into the first chamber 27 and a second opening 31 may be used to insert a second substance into the second chamber 28.

Figure 7:
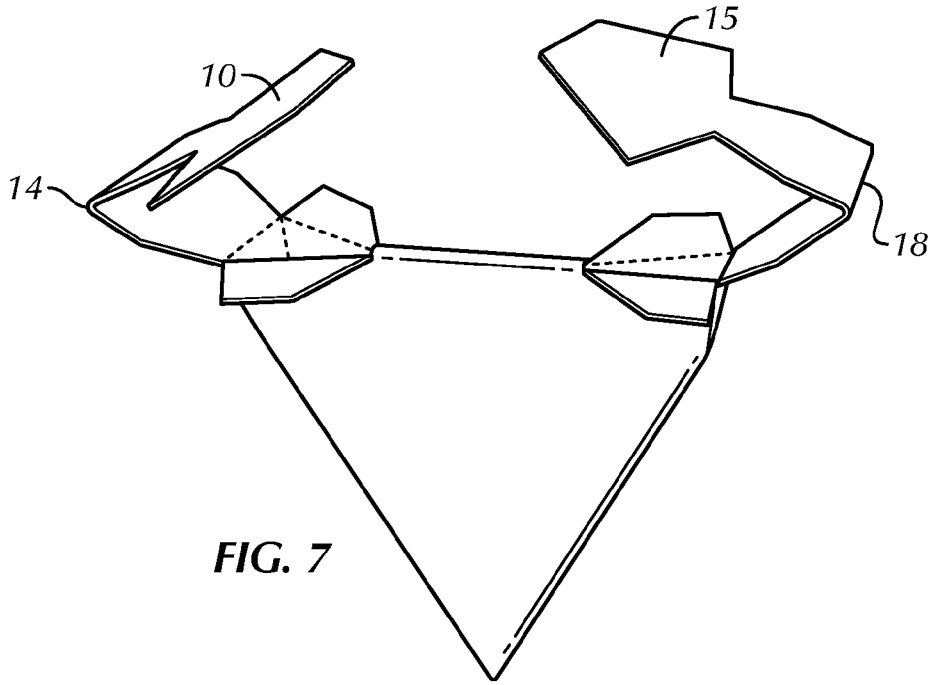
FIG. 7 is an orthogonal view of a first blank with folded center tabs, according to an embodiment.

FIG. 7 is an orthogonal view of a first blank with partially folded center tabs, according to an embodiment.

The first center tab 10 and the second center tab 15 are partially folded inward at a first center tab midpoint 14 and a second center tab midpoint 18, respectively.

Figure 8:
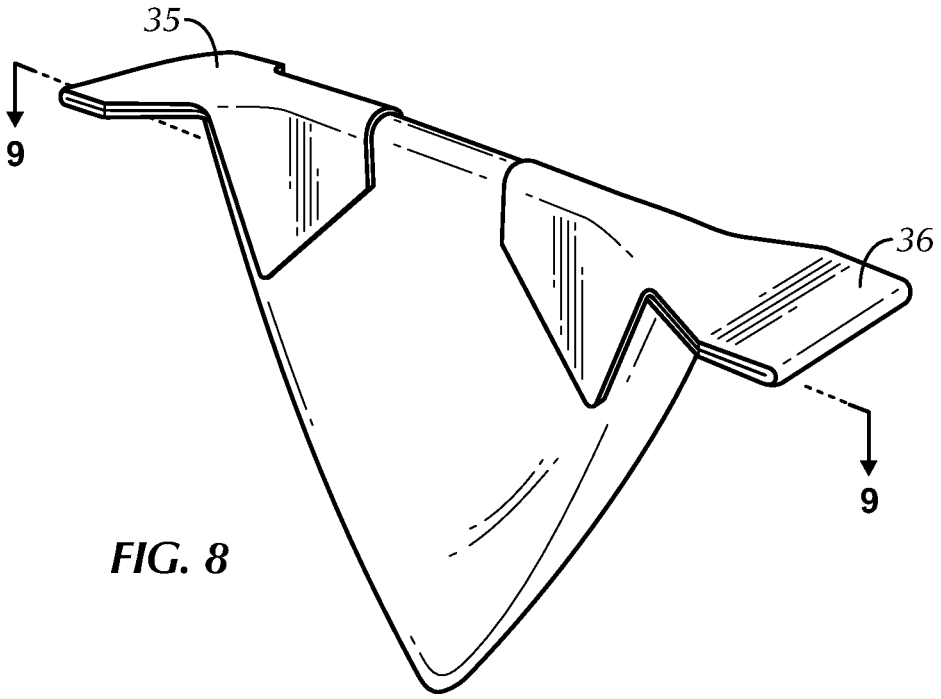
FIG. 8 is an orthogonal view of a first completed container with completed access fins, according to an embodiment.

FIG. 8 is an orthogonal view of a completed first container with completed access fins, according to an embodiment.

The first center tab 10 and the second center tab 15 are now completely folded and sealed, forming completed access fins 35 and 36, which secure the first substance inside the first chamber 27 and the second substance inside the second chamber 28.

Throughout the construction sequence illustrated in FIGS. 1-8, various opposed elements of the blank are affixed together using any available sealing mechanism.

Figure 9:
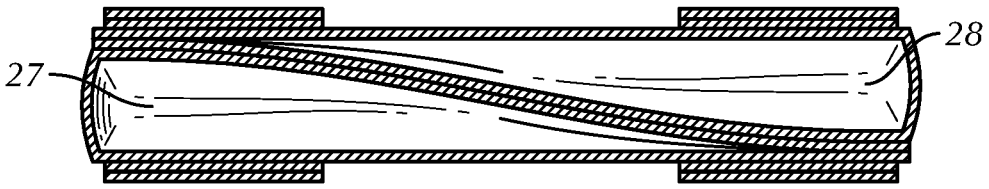
FIG. 9 is a cut-away top view of a completed first container, according to an embodiment.

FIG. 9 is a cut-away top view of a completed first container, according to an embodiment.

Note that FIG. 9 is looking down from the top of the first container (if the first container is positioned such as in FIG. 8) while looking past the top portion of the first container (the access fins and top surface) to see the inside of the first container.

The first chamber 27 is a hollow chamber which may be used to store a first substance. The first substance is accessible by removing the first access fin 35, thereby breaching the first chamber 27. The second chamber 28 is a hollow chamber which may be used to store a second substance. The second substance is accessible by removing the second access fin 36, thereby breaching the second chamber 28. Both the first chamber 27 and the second chamber 28 are typically airtight and sealed such that their respective substances cannot exit their respective chamber.

Figure 10:
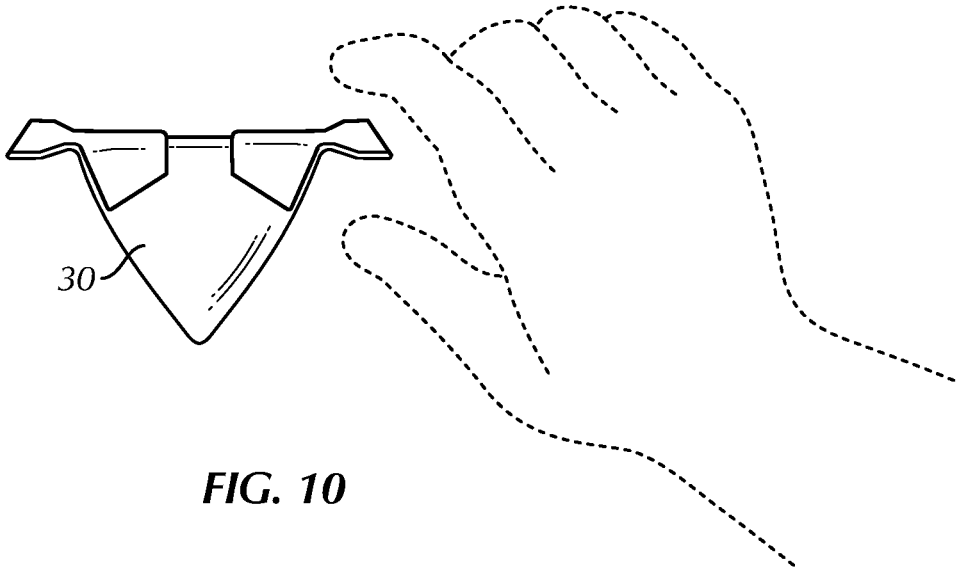
FIG. 10 is an orthogonal view of a completed first container and an operative human hand preparing to grip an access fin.

FIG. 10 is an orthogonal view of a completed first container and an operative human hand preparing to grip an access fin.

The user is preparing to grip access tab 36. The user opens the container by breaching one or more of the chambers. Typically the user will grip and remove an access tab in order to facilitate beaching of the chamber, exposing, and therefore allowing access to the substance in the interior of the chamber. The substance may then be expressed from the chamber.

The user is not required to open both chambers and can just use the first substance or the second substance if desired. A 'peel-and reseal' multi-use adhesive mechanism may be used in applications of the invention whereupon it would be advantageous to do so. Additionally, the construction allows the corner adjacent a removed access fin to be folded over, for instances in which a portion of the contents of a chamber are desired to be retained for later use.

It is further noted that if the user wants to utilize both substances without removing both access fins in the triangular-shaped embodiments, the user can simply remove the third corner 30 and both substances may then be expressed simultaneously. Thus for example, a container may contain cream and sugar. A user who desires cream or sugar can remove the respective access fin and pour the desired substance into his or her cup. A user who desires both cream and sugar can either remove both access fins to express both substances consecutively, or simply remove the third corner 30 and pour both sugar and cream out of corner 30.

Figure 11:
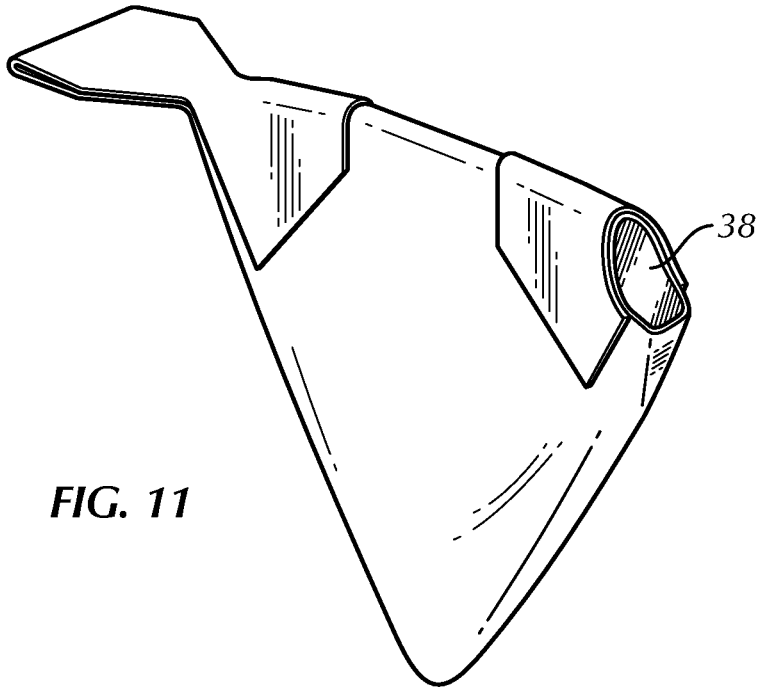
FIG. 11 is an orthogonal view of a completed first container with an access fin removed by a human hand.

FIG. 11 is an orthogonal view of a completed first container with an access fin removed by a human hand, exposing a first dispensing outlet.

A breached corner 38 shows access fin 36 now removed, thereby exposing the substance in chamber 28.

Figure 12:
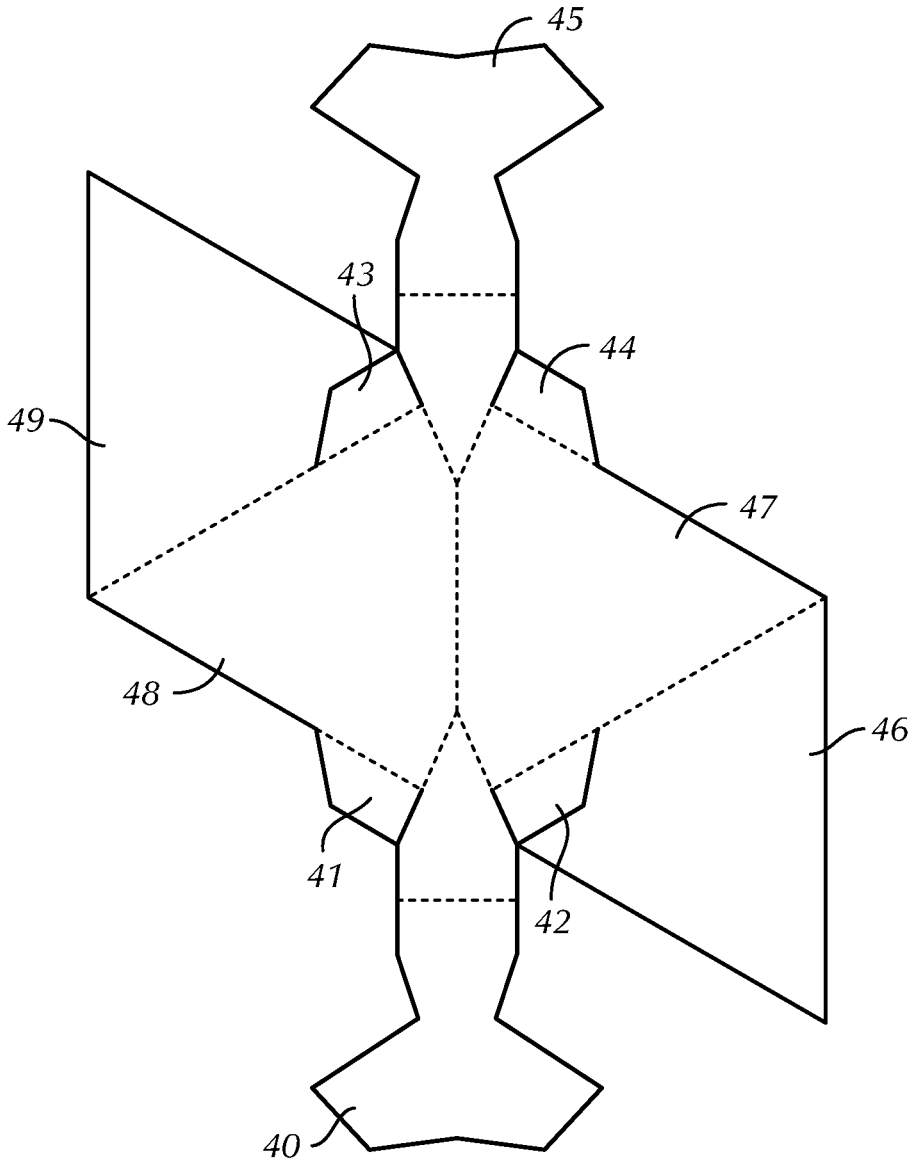
FIG. 12 is a flat view of a second container comprising a second blank not yet constructed, according to an embodiment.

FIG. 12 is a flat view of a second container not yet constructed comprising a second blank with opposing center tabs, according to an embodiment. This embodiment is similar to the embodiment illustrated in FIG. 1, although note the different position of the center tabs. FIGS. 12-18 show an assembly sequence for this embodiment of the container.

Center tab 40 has left flanking tab 41 and right flanking tab 42, while center tab 45 has left flanking tab 43 and right flanking tab 44. There are also outer triangular sections 49 and 46, and inner triangular sections 48 and 47.

Figure 13:
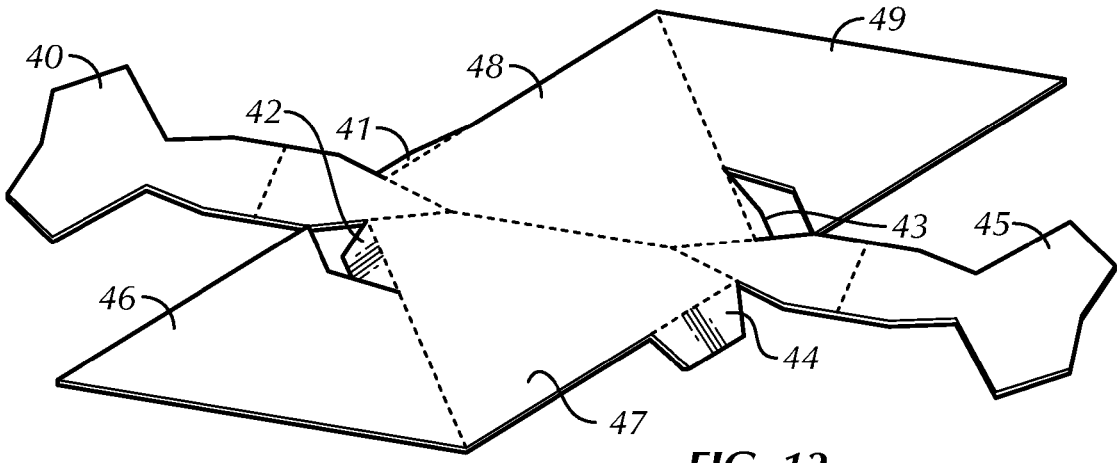
FIG. 13 is an orthogonal view of a second blank with folded flanking tabs, according to an embodiment.

FIG. 13 is an orthogonal view of a second blank with partially folded flanking tabs, according to an embodiment.

The left flanking tab 41 and right flanking tab 42 of center tab 40 are partially folded, while the left flanking tab 43 and right flanking tab 44 of center 45 are partially folded.

Figure 14:
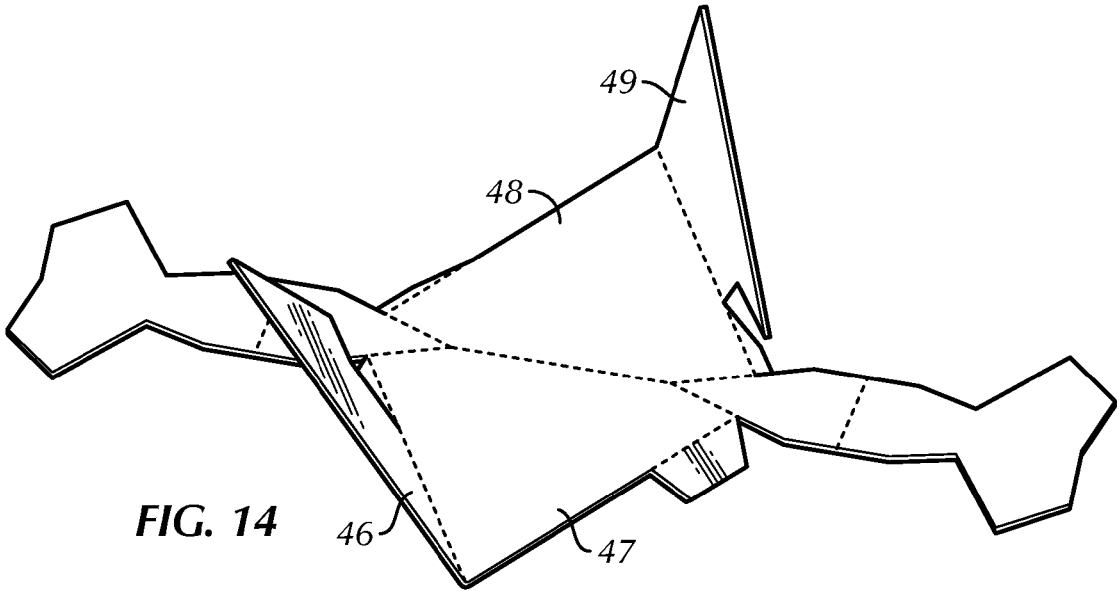
FIG. 14 is an orthogonal view of a second blank with partially folded triangular sections, according to an embodiment.

FIG. 14 is an orthogonal view of a second blank with partially folded triangular sections, according to an embodiment.

Outer triangular sections 46 and 49 are folded towards inner triangular sections 47 and 48, respectively.

Figure 15:
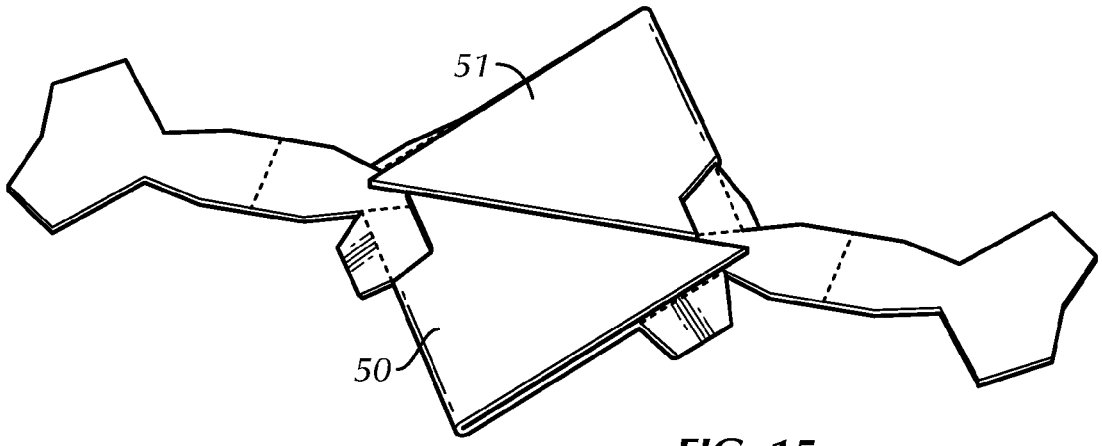
FIG. 15 is an orthogonal view of a second blank with folded and sealed triangular sections, according to an embodiment.

FIG. 15 is an orthogonal view of a second blank with completely folded over triangular sections, according to an embodiment.

Outer triangular section 46 is folded over and superimposed upon inner triangular section 47 creating hollow chamber 50. Outer triangular section 49 is folded over and superimposed upon inner triangular section 48, creating hollow chamber 51. Portions of the perimeter of the superimposed sections may be affixed together as necessary to suit the needs of the manufacturing process.

Figure 16:
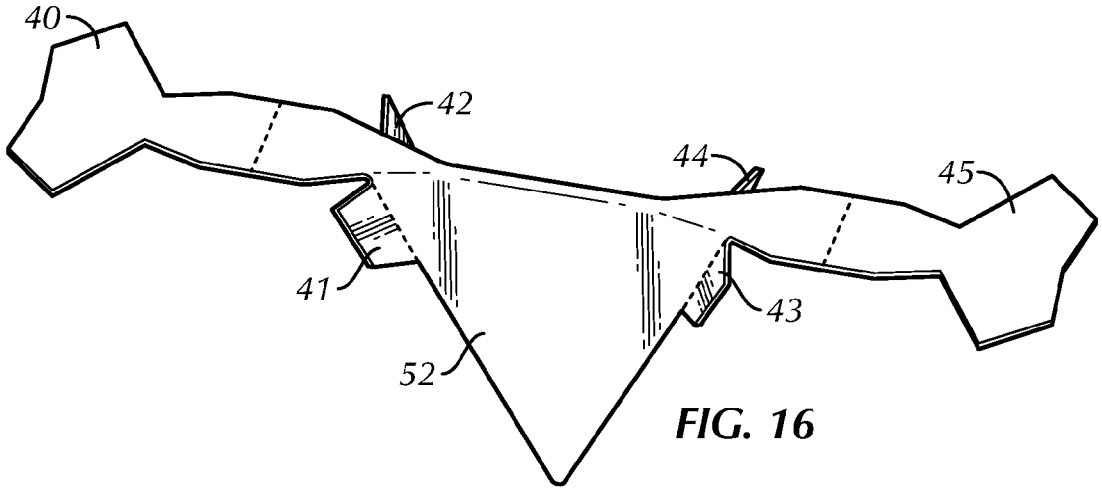
FIG. 16 is an orthogonal view of a second blank with superimposed triangular chambers, according to an embodiment.

FIG. 16 is an orthogonal view of a second blank with superimposed triangular chambers, according to an embodiment.

The figure is rotated one-hundred eighty degrees on an axis bisecting center tabs 40 and 45. The triangular chambers 50 and 51 are now folded up to meet each other and may be affixed together, creating unitary body 52.

Figure 17:
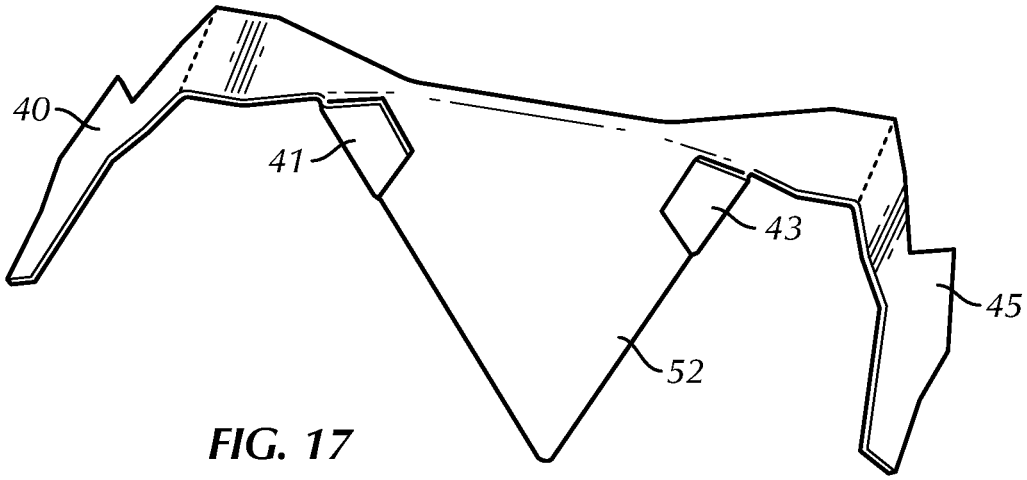
FIG. 17 is an orthogonal view of a second blank with partially folded center tabs, according to an embodiment.

FIG. 17 is an orthogonal view of a second blank with partially folded center tabs, according to an embodiment.

Center tab 40 and center tab 45 are folded downward towards opposing flanking tabs 41 and 42, and 43 and 44, respectively.

Figure 18:
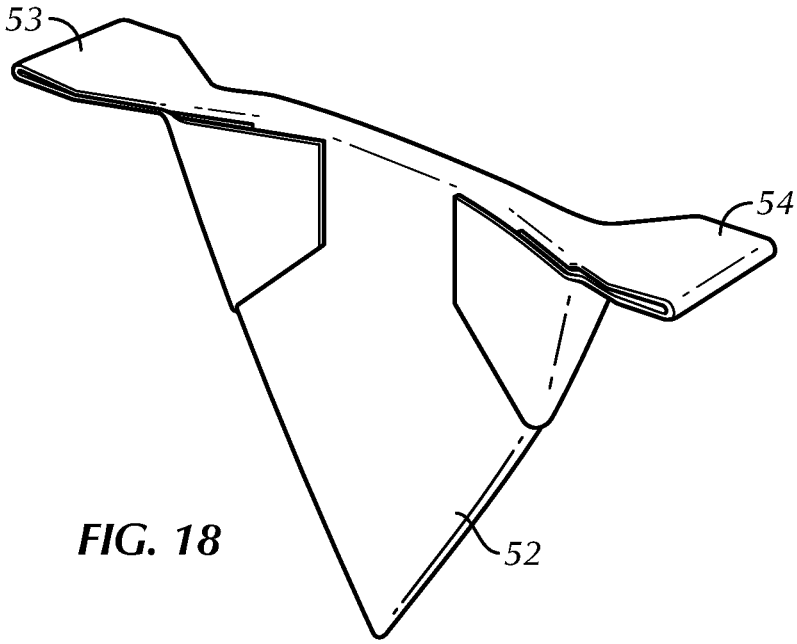
FIG. 18 is an orthogonal view of a completed second container with folded and sealed center tabs, forming completed access fins, according to an embodiment.

FIG. 18 is an orthogonal view of a completed second container with folded and sealed center tabs forming completed access fins, according to an embodiment.

Center tab 40 and center tab 45 are completely folded and sealed. Center tab 40 has been folded and sealed against opposing surfaces of flanking tabs 41 and 42, forming access fin 53. Center tab 45 has been folded and sealed against opposing surfaces of flanking tabs 43 and 44, forming access fin 54.

Figure 19:
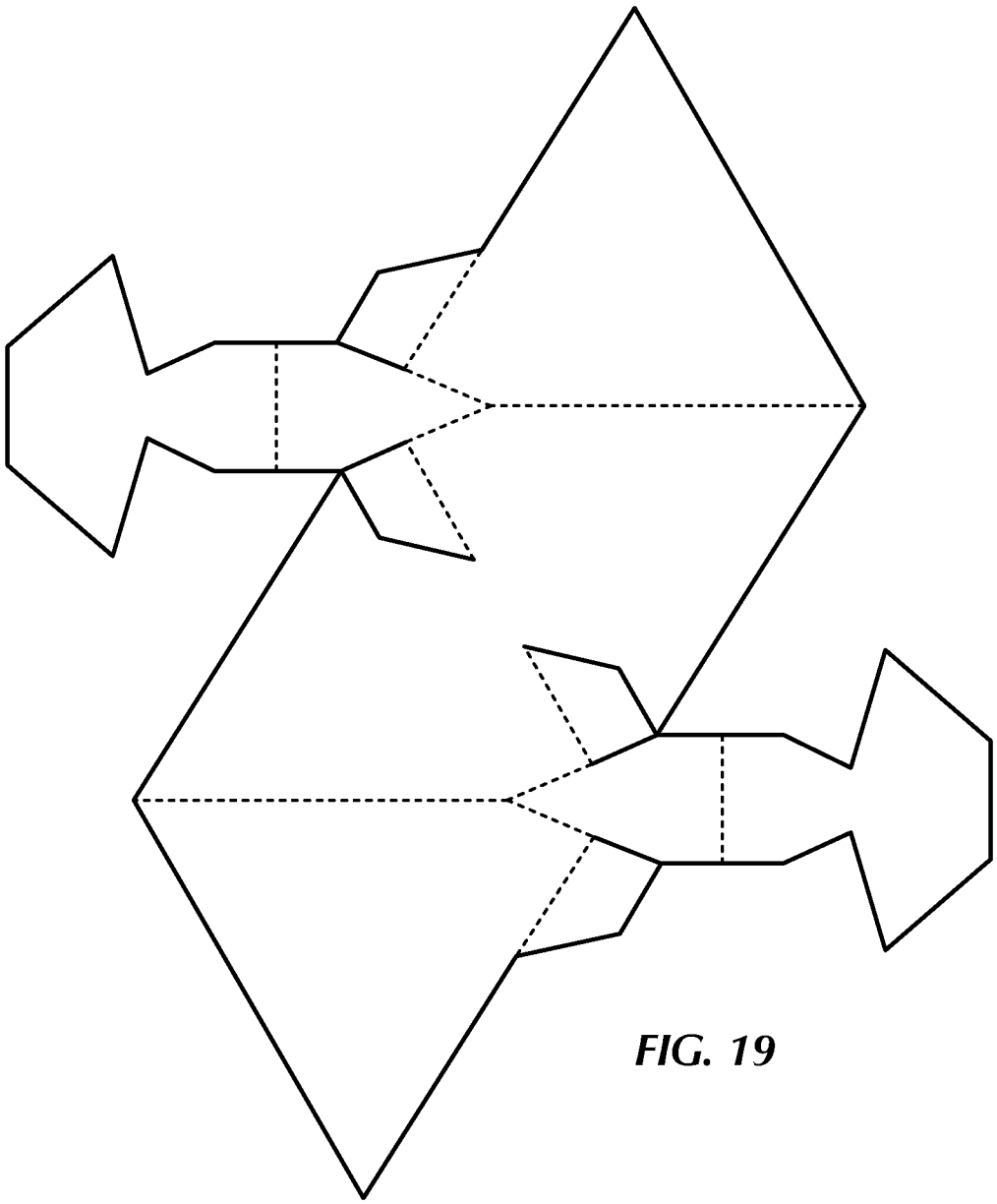
FIG. 19 is a flat view of a third container, comprising a third blank not yet constructed, according to an embodiment.

FIG. 19 is a flat view of a third container, comprising an unconstructed third blank, according to an embodiment.

The third sachet can be constructed similarly to the methods described for the first container and the second container, as described above.

Figure 20:
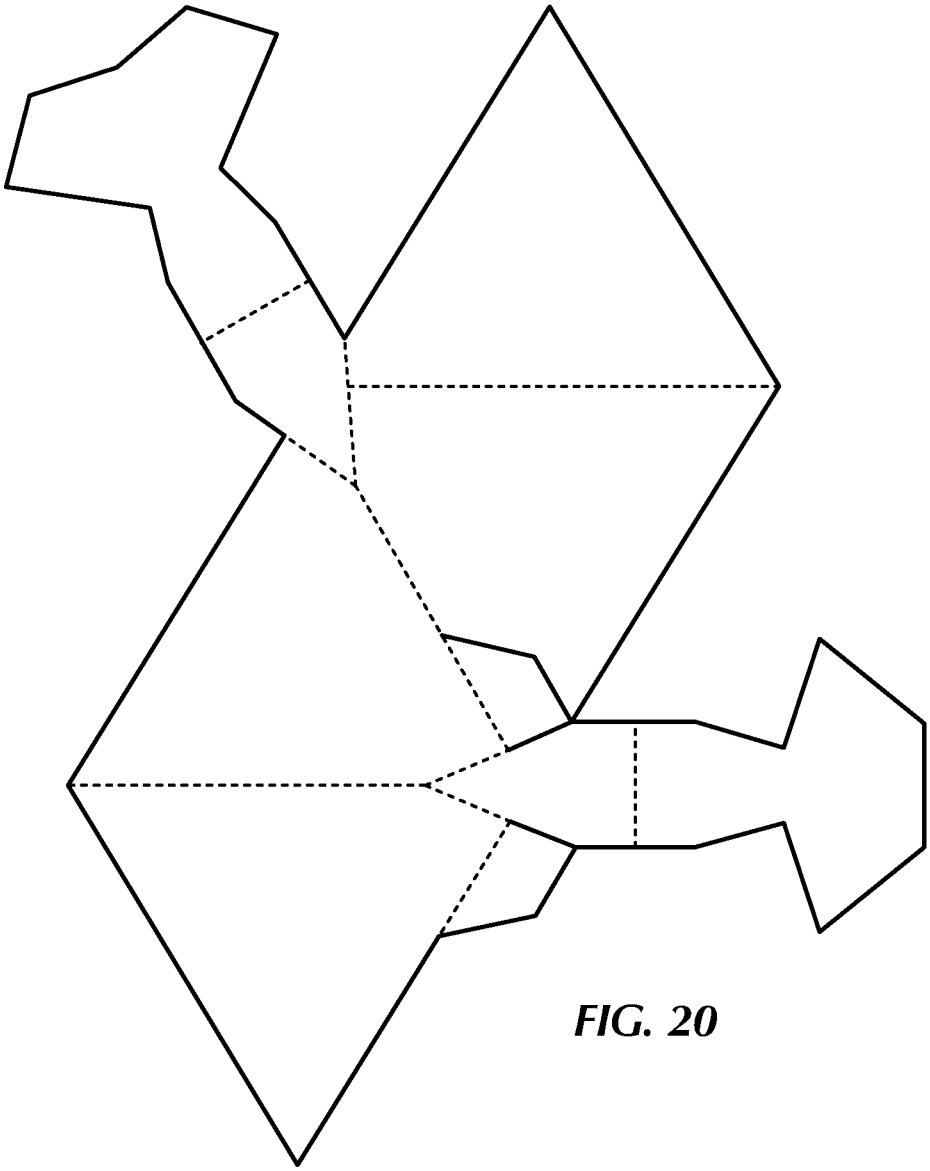
FIG. 20 is a flat view of a fourth container, comprising a fourth blank not yet constructed, according to an embodiment.

FIG. 20 is a flat view of a fourth container, comprising an unconstructed fourth blank, according to an embodiment.

The fourth container can be constructed similarly to the methods described for the first container and the second container, as described above.

Figure 21:
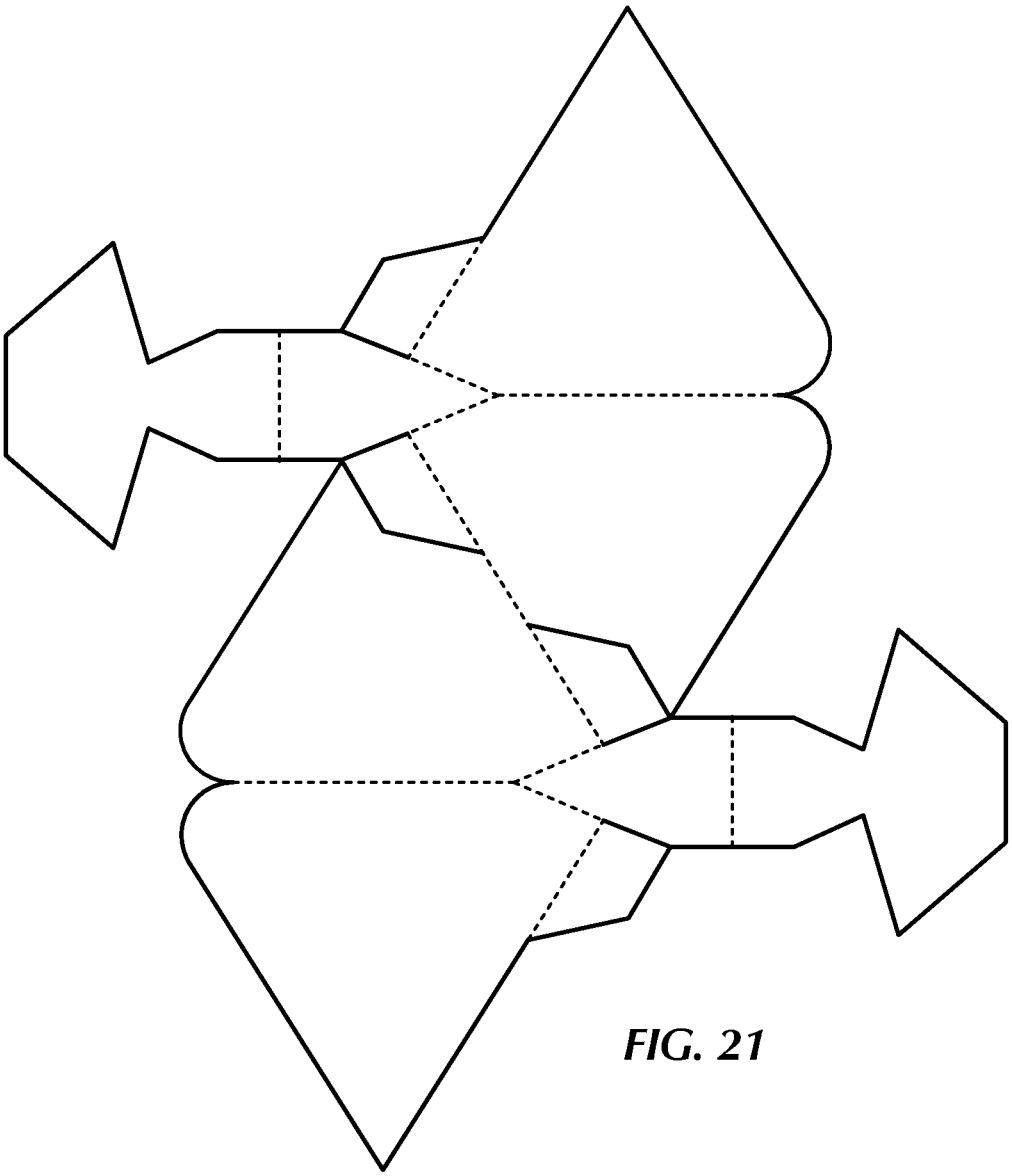
FIG. 21 is a flat view of a fifth container with rounded free corner, comprising a container not yet constructed, according to an embodiment.

FIG. 21 is a flat view of a fifth container with a rounded free corner, comprising an unconstructed fifth blank, according to an embodiment.

The fifth embodiment illustrated in FIG. 21 is a variation of the embodiment illustrated in FIG. 1, that when folded and sealed has a unitary body comprising a rounded free corner.

Figure 22:
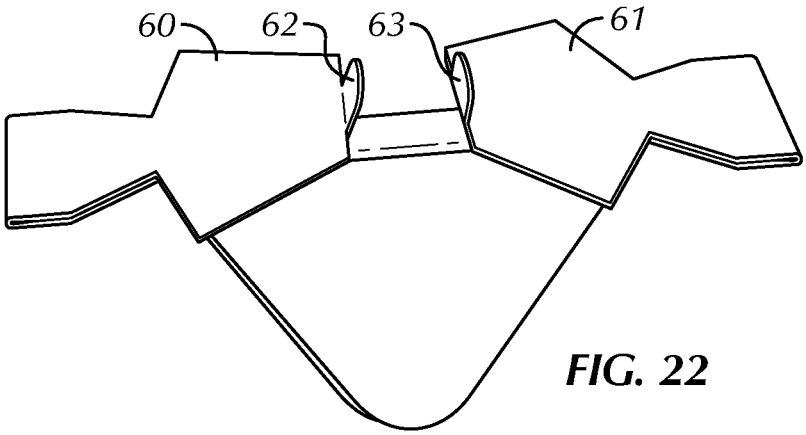
FIG. 22 is an orthogonal view of a completed closed fifth container comprising a peel and reseal mechanism, according to an embodiment.

FIG. 22 is an orthogonal view of a sixth completed container comprising a peel and reseal mechanism, according to an embodiment. The container has center tab extensions 62 and 63.

A "peal and reseal" mechanism is a demonstrated in which a left flap 60 and a right flap 61 can each be reversibly sealed and unsealed. Each center tab can be secured on its respective flanking tabs, and unsealed to expose the contents within the chamber.

Figure 23:
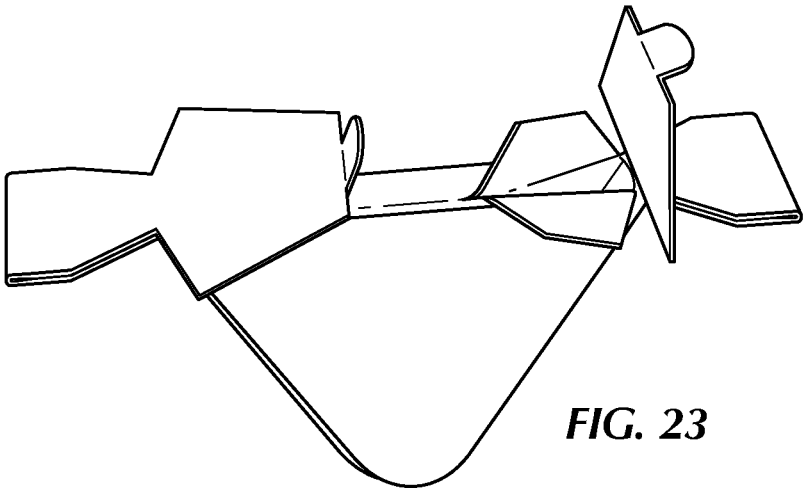
FIG. 23 is an orthogonal view of a completed open fifth container comprising a peel and reseal mechanism, according to an embodiment.

FIG. 23 is an orthogonal view of a completed partially opened container comprising a peel and reseal mechanism, according to an embodiment.

Center tab 61 has been reversibly unsealed from its respective flanking tabs, by pulling on center tab extension 63, thus opening the chamber.

Figure 24:
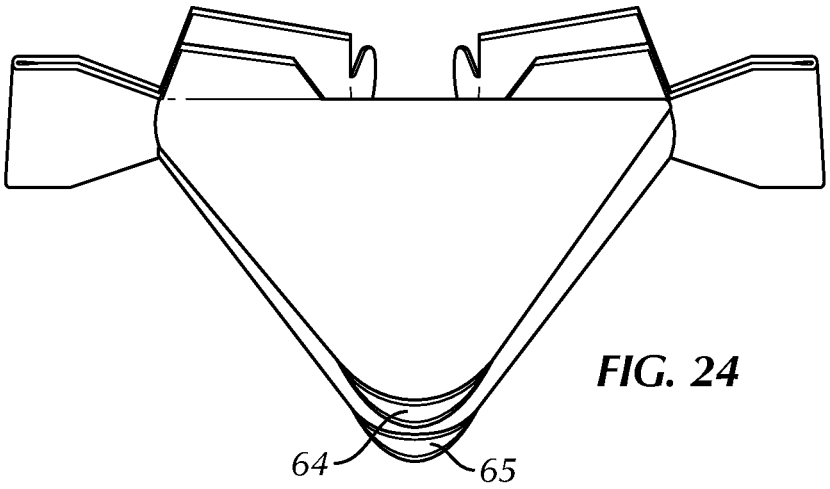
FIG. 24 is an orthogonal view of a partially completed fifth container comprising chambers with unsealed free corners, according to an embodiment.

FIG. 24 is an orthogonal view of a completed container with unsealed free corners, according to an embodiment.

A top opening 65 and a bottom opening 66 can be left unsealed during construction of the container. Unsealed free corners comprise and alternative sealing mechanism and allow flexibility in developing a form, fill, and seal manufacturing process.

Figure 25:
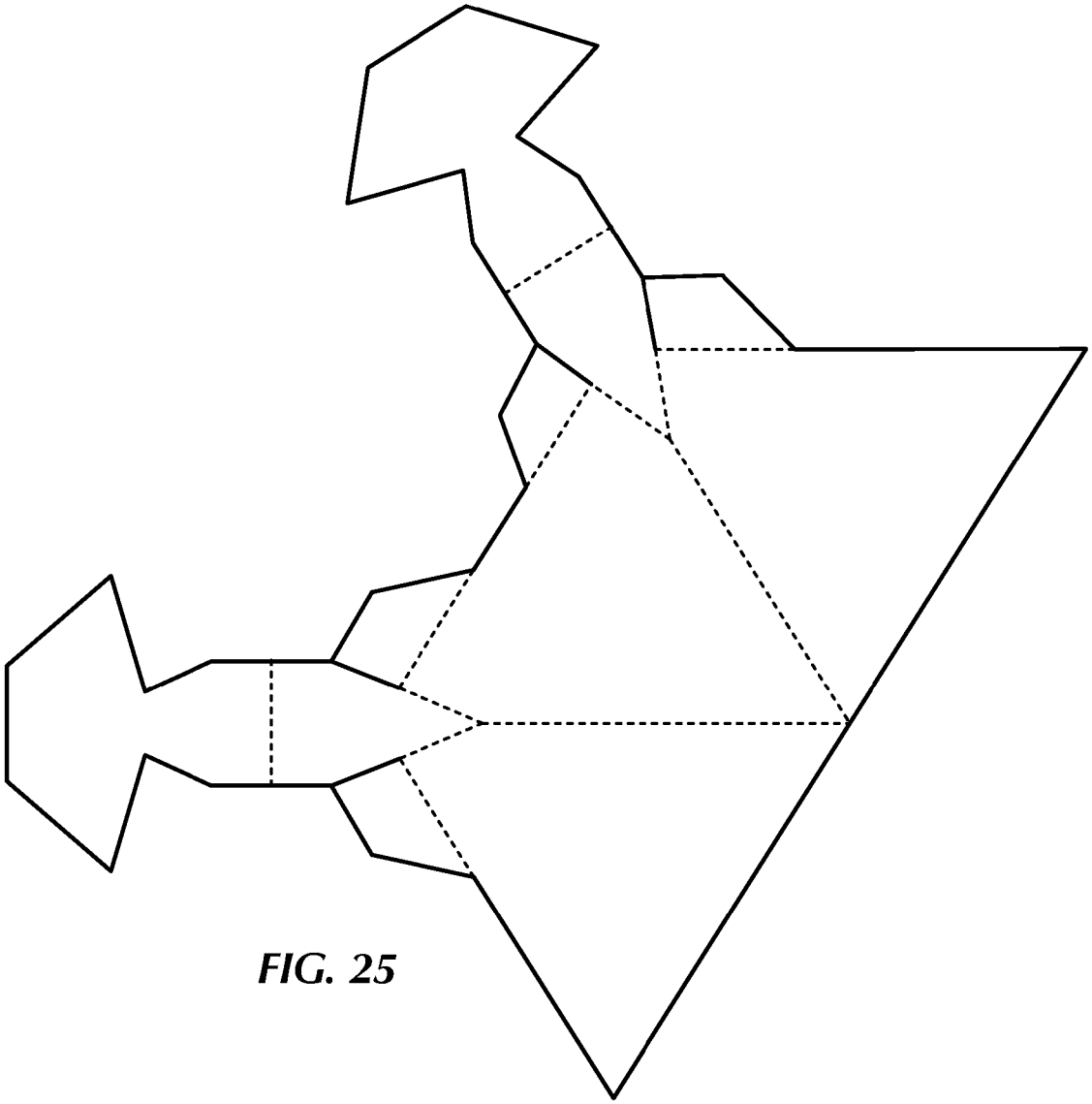
FIG. 25 is a flat view of a sixth container, comprising a sixth blank not yet constructed, according to an embodiment.

FIG. 25 is a flat view of a seventh container, comprising an unconstructed seventh blank, according to an embodiment.

The seventh blank comprises only three triangular shaped sections, instead of four. The center triangular polygon serves as a common barrier between both chambers in the completed container. The folding sequence can be accomplished similarly to the previous embodiments. Containers comprising a blank with three sections are completed according to an abbreviated folding sequence.

Figure 26:
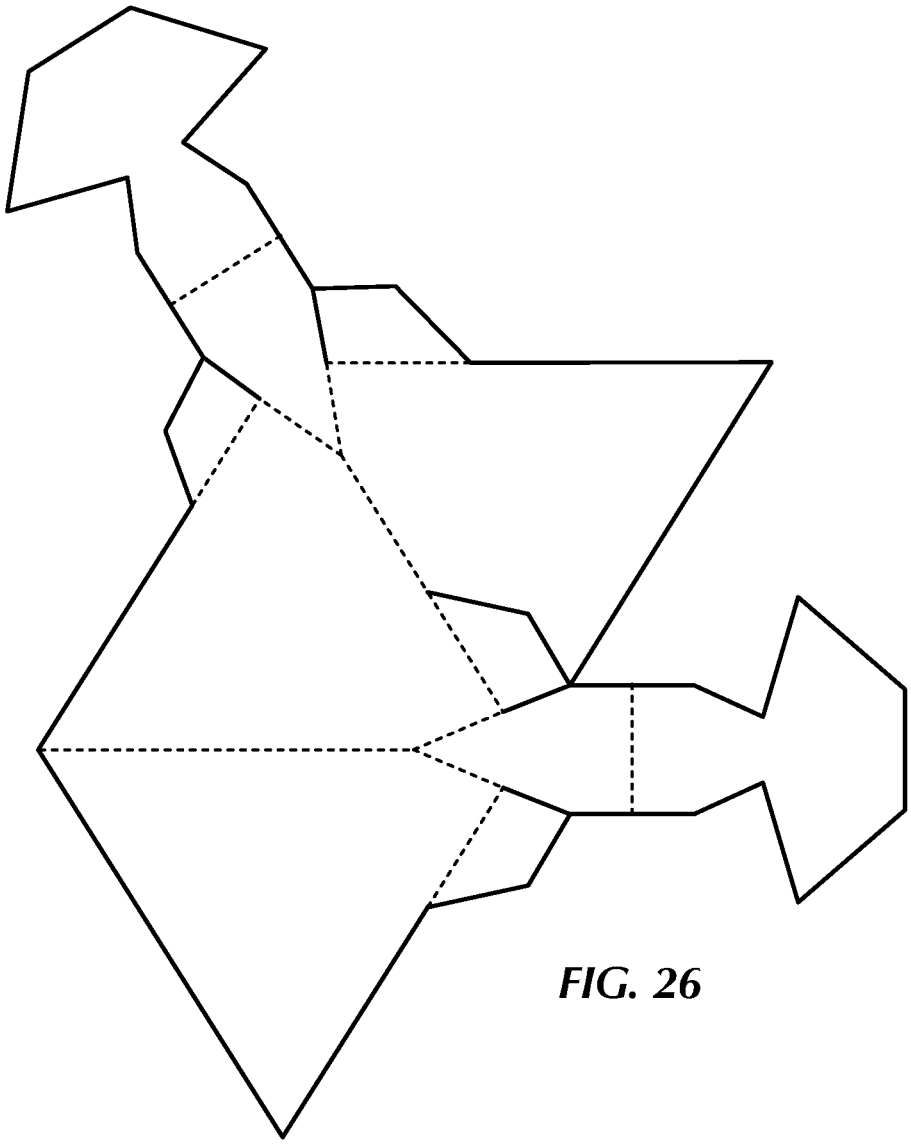
FIG. 26 is a flat view of a seventh container, comprising a seventh blank not yet constructed, according to an embodiment.

FIG. 26 is a flat view of an eighth container, comprising an unconstructed eighth blank, according to an embodiment.

The eighth blank also comprises three polygonal sections which can be folded and sealed to facilitate construction of the eighth embodiment.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A container, comprising:

a first sealed chamber adapted to hold a first substance;

a second sealed chamber adapted to hold a second substance, the second chamber being adjacent to and superimposed on the first chamber;

a first access fin extruding from a first corner of the container that when removed, breaches the first chamber; and a second access fin extruding from a second corner of the container that when removed, breaches the second chamber.

2. The container as recited in claim 1, wherein the first chamber and the second chamber are substantially equal in size and shape.

3. The container recited in claim 1, wherein the first chamber and the second chamber are substantially triangular in shape.

4. The container as recited in claim 1, wherein the first chamber and the second chamber are superimposed.

5. The container as recited in claim 1, wherein the first chamber is filled with a first substance and the second chamber is filled with a second substance.

6. The container as recited in claim 1, wherein the container is constructed from a flat material.

7. The container as recited in claim 6, wherein the flat material is cut into a pre-determined shape and folded to construct the container.

8. The container recited in claim 6, wherein the flat material is a paper product or metalized plastic.

9. A container, comprising:

a first sealed chamber adapted to hold a first substance;

a second sealed chamber adapted to hold a second substance, the second chamber being a adjacent to and superimposed on the first chamber;

a first access fin located at a first corner of the container that when removed, breaches the first chamber;

a second access fin located at a second corner of the container that when removed, breaches the second chamber; and a third corner which, when removed, exposes both the first substance and the second substance, wherein the first chamber and the second chamber are substantially triangular in shape.

10. The container as recited in claim 9, wherein the first access fin extrudes from the first corner, and the second access fin extrudes from the second corner.

11. A container, comprising:

a first sealed chamber adapted to hold a first substance;

a second sealed chamber adapted to hold a second substance, the second chamber being adjacent to and superimposed on the first chamber;

a first access fin located at a first corner of the container that when removed, breaches the first chamber; and a second access fin located at a second corner of the container that when removed, breaches the second chamber, wherein the first access fin and the second access fin are transversely oriented to a plane of maximum cross-sectional diameter of the first chamber and the second chamber.

12. The container as recited in claim 11, wherein the first access fin extrudes from the first corner, and the second access fin extrudes from the second corner.

13. A container, comprising:

a first sealed chamber adapted to hold a first substance a second sealed chamber adapted to hold a second substance, the second chamber being adjacent to and superimposed on the first chamber;

a first access fin located at a first corner of the container that when removed, breaches the first chamber; and a second access fin located at a second corner of the container that when removed, breaches the second chamber, wherein the container is constructed from a flat material, wherein the flat material embodies at least three polygonal sections.

14. The container recited in claim 13, wherein each polygonal section shares at least one common side with another polygonal section.

15. The container as recited in claim 13, wherein the first access fin extrudes from the first corner, and the second access fin extrudes from the second corner.

16. A container comprising:

a first sealed chamber adapted to hold a first substance;

a second sealed chamber adapted to hold a second substance, the second chamber being adjacent to and superimposed on the first chamber;

a first access fin located at a first corner of the container that when removed, breaches the first chamber; and a second access fin located at a second corner of the container that when removed, breaches the second chamber, wherein the container is constructed from a flat material, wherein the flat material embodies at least two center tab extensions.

17. The container as recited in claim 16, wherein the center tab extensions in the flat material form the access fins of the container.

18. The container recited in claim 16, wherein the flat material comprises a first pair of flanking tabs on each side of the first center tab extension.

19. The container recited in claim 16, wherein the flat material comprises a second pair of flanking tabs on each side of the second center tab extension.

20. The container as recited in claim 16, wherein the first access fin extrudes from the first corner, and the second access fin extrudes from the second corner.

21. A container, comprising:

at least two compartments; at least a first compartment structured for being filled with a first substance;

at least a second compartment structured for being filled with a second substance;

a portion of the first compartment marked or constructed in a manner to facilitate the creation of an opening in the first compartment;

a portion of the second compartment marked or constructed in a manner to facilitate the creation of an opening in the second compartment;

a first access fin extruding from the first compartment and constructed such that when the first access fin is torn an interior of the first compartment is exposed; and a second access fin extruding from the second compartment and constructed such that when the second access fin is torn an interior of the second compartment is exposed.

22. The container as recited in claim 21, wherein the second compartment is adjacent to the first compartment.

23. The container as recited in claim 21, wherein the second compartment is superimposed on the first compartment.

24. The container as recited in claim 21, wherein the first access fin is located at a corner of the first compartment and the second access fin is located at a corner of the second compartment.

25. The container as recited in claim 21, wherein the body of the container is substantially triangular in shape.

26. The container as recited in claim 21, wherein the container may be constructed from a pre-cut blank, folded and sealed to create the container.

* * * * *